US010144609B2

(12) United States Patent
Gonzalez Perello et al.

(10) Patent No.: US 10,144,609 B2
(45) Date of Patent: Dec. 4, 2018

(54) MEDIA-SHEET STACKING SYSTEMS

(71) Applicant: HEWLETT-PACKARD DEVELOPMENT COMPANY, L.P., Houston, TX (US)

(72) Inventors: Daniel Gonzalez Perello, Terrassa (ES); Andreu Oliver, Barcelona (ES); Ismael Chanclon Fernandez, Sant Cugat del Valles (ES); Joseba Ormaechea Saracibar, San Cugat del Valles (ES); Xavier Miguel Royo, Sant Cugat del Valles (ES); Ruben Prats Gonzalez, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/313,871

(22) PCT Filed: Jun. 3, 2014

(86) PCT No.: PCT/EP2014/061513
§ 371 (c)(1),
(2) Date: Nov. 23, 2016

(87) PCT Pub. No.: WO2015/185119
PCT Pub. Date: Dec. 10, 2015

(65) Prior Publication Data

US 2017/0101282 A1 Apr. 13, 2017

(51) Int. Cl.
*B65H 29/54* (2006.01)
*B65H 31/26* (2006.01)
(Continued)

(52) U.S. Cl.
CPC ..... *B65H 31/26* (2013.01); *B65H 29/18* (2013.01); *B65H 31/02* (2013.01); *B65H 2301/421* (2013.01); *B65H 2301/4212* (2013.01); *B65H 2301/442* (2013.01); *B65H 2301/4422* (2013.01); *B65H 2403/41* (2013.01); *B65H 2404/268* (2013.01);
(Continued)

(58) Field of Classification Search
CPC ..... B65H 31/26; B65H 29/18; B65H 2405/11425; B65H 2701/1313
USPC ..... 271/308
See application file for complete search history.

(56) References Cited

U.S. PATENT DOCUMENTS 3,814,415 A * 6/1974 Hunter ..... B65H 29/38 271/176
5,996,993 A 12/1999 Arikawa
(Continued)

OTHER PUBLICATIONS

European Patent Office, International Search Report and Written Opinion for PCT/EP2014/061513 dated Jun. 3, 2015 (18 pages).

*Primary Examiner* — Howard J Sanders
(74) *Attorney, Agent, or Firm* — HP Inc. Patent Department

(57) ABSTRACT

A media-sheet stacking system (10) for stacking media sheets on a device output tray (OT) comprises a kicker (25) to advance a media sheet along the output tray by pushing a trailing edge of the media sheet as it exits the device, and a movable element (32*a*) arranged to face the output tray across a space that receives media sheets exiting the device. A drive mechanism (33) is provided to drive the movable element in the direction of advance of the media sheet along the output tray.

13 Claims, 4 Drawing Sheets

(51) Int. Cl.
*B65H 29/18* (2006.01)
*B65H 31/02* (2006.01)

(52) U.S. Cl.
CPC .. *B65H 2404/2682* (2013.01); *B65H 2404/61* (2013.01); *B65H 2404/733* (2013.01); *B65H 2405/115* (2013.01); *B65H 2405/11151* (2013.01); *B65H 2405/11425* (2013.01); *B65H 2406/122* (2013.01); *B65H 2701/11312* (2013.01); *B65H 2701/1313* (2013.01); *B65H 2801/06* (2013.01)

(56) References Cited

U.S. PATENT DOCUMENTS

| | | | | |
|---|---|---|---|---|
| 6,625,561 | B1 | 9/2003 | Tullis | |
| 6,848,688 | B1 | 2/2005 | Ruthenberg et al. | |
| 7,411,205 | B2 | 8/2008 | Amarakoon et al. | |
| 7,461,837 | B2 * | 12/2008 | Saito | B42C 1/12 270/58.07 |
| 2006/0208411 | A1 | 9/2006 | Saito | |
| 2009/0151435 | A1 | 6/2009 | Moore et al. | |
| 2010/0066005 | A1 | 3/2010 | Ueda | |
| 2014/0008867 | A1 | 1/2014 | Ohtani et al. | |
| 2017/0081141 | A1 * | 3/2017 | Chanclon Fernandez | B65H 31/02 |

* cited by examiner

FIG.3
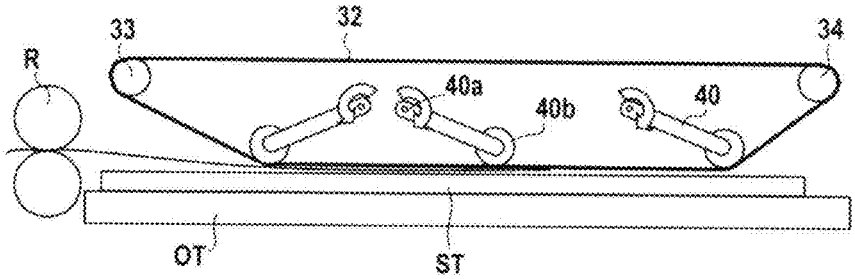
FIG.5A
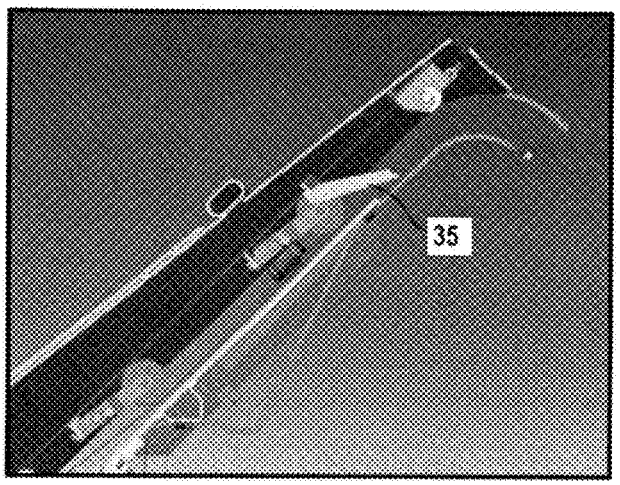
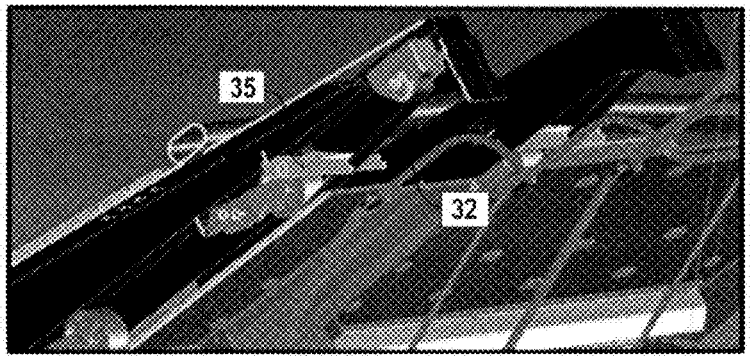
FIG.5B

MEDIA-SHEET STACKING SYSTEMS

BACKGROUND

The present disclosure relates to media-sheet stacking systems for stacking media sheets on output trays of printers and other devices, as well as to methods of stacking media sheets, and devices comprising the media-sheet stacking systems.

Many devices, for instance printers, are designed to have an integrated or removable output tray in which output media sheets are stacked waiting for collection by a user. Typically, in a printer, an output roller pushes printed media sheets towards the output tray.

BRIEF DESCRIPTION OF THE DRAWINGS

FIG. 3 is a diagram illustrating an example of a biasing mechanism that can be used in a print-medium buffering system according to an example of the present disclosure.

FIGS. 5 A and 5 B are pictures illustrating an example of a one-way valve element.

DETAILED DESCRIPTION

Figure 1:
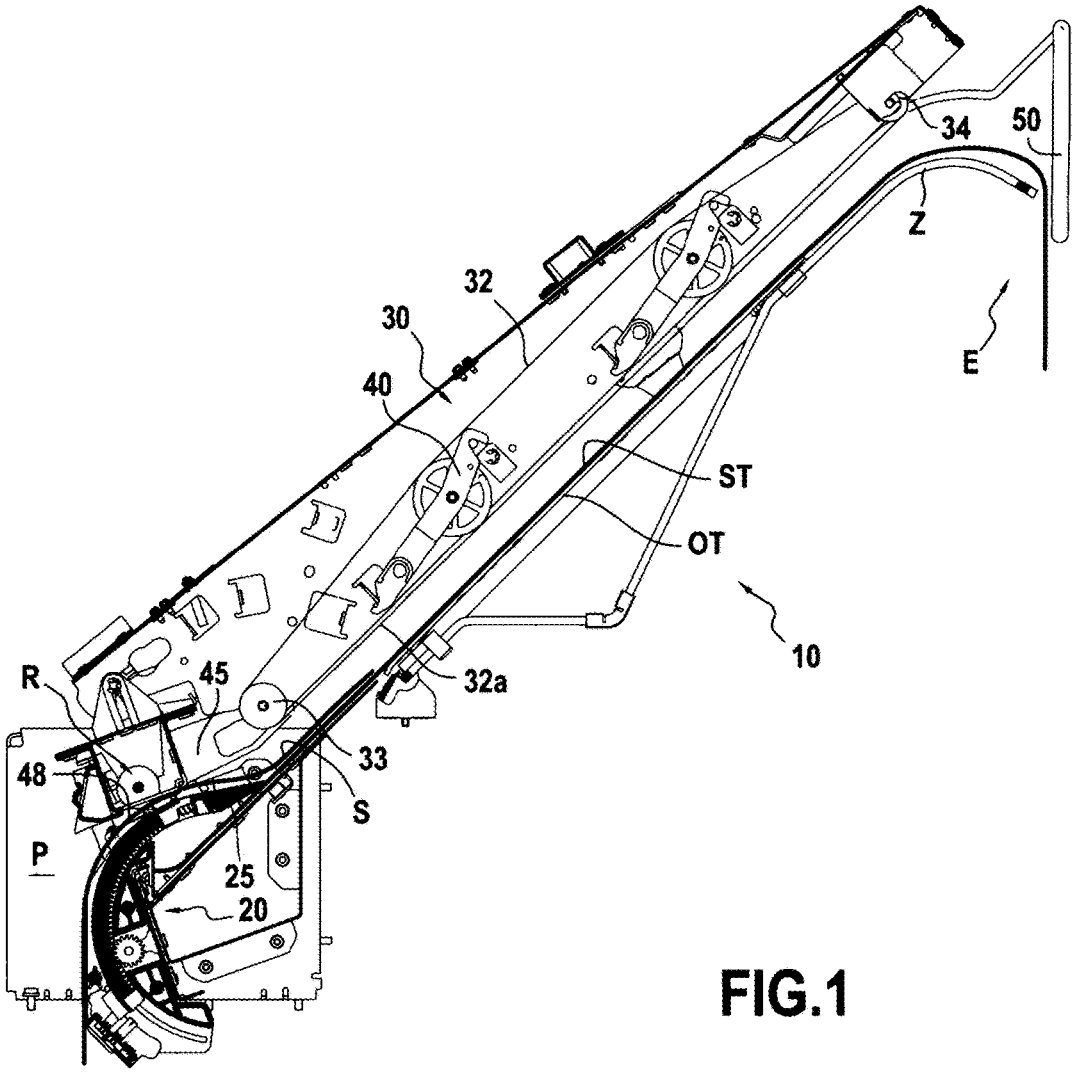
FIG. 1 represents an example of a media-sheet stacking system according to the present disclosure, and is a cross-sectional view.

Various problems can arise during the stacking of a media sheet in the output tray of a device, including the following:

- The trailing edge of the media sheet may not be properly ejected from the device.
- The trailing edges of media sheets that are already stacked on the output tray may block the device's exit path.
- Media sheets made from thin materials may buckle when pushed to the output tray (e.g. by an output roller).
- The leading edge of the media sheet may curl or even roll up as the sheet advances into the output tray, and this problem is exacerbated when the media sheet being fed has been in a rolled up condition at an earlier time.
- In a case where the output tray is shorter than the media sheet being stacked, the media sheet may roll up at the exit of the output tray (i.e. the end opposite to where the media sheet exits the printer or other device). NB in large format printers the output trays are normally shorter than the media sheets being printed, otherwise they would be too bulky.
- As a media sheet is ejected from a printer or other device it may drag along media sheets that were already stacked on the output tray.

In certain large-format printers and like devices, stacking problems do not arise, because the printed media are outputted in the form of a web: in other words the medium is supplied in the form of a continuous web wound on a spool and after printing (or other media-handling) the web is wound onto another spool. In LED printers, the problem of curling during stacking is reduced because the printing process includes a fusing step which tends to reverse any inherent curl in the media sheets.

Certain types of printers incorporate a kicker to mitigate the problem of the trailing edge of a media sheet not being properly ejected from the output roller. The kicker is arranged to give a push to the trailing edge of the media sheet to send the sheet into the output tray.

Some other types of printers incorporate a blower unit to blow air to prevent media sheets from sticking together, and mitigate the problem of dragging during stacking of the media sheets.

Yet other types of printers incorporate a lid on the output tray to limit the height of the space into which media sheets are fed when they exit the printer. This can reduce curling but also limits the number of sheets that can be output before a user has to empty the output tray.

Still other types of printers incorporate a floating lid on the output tray and the position of the floating lid changes as more media sheets become stacked on the output tray. In this way there is less of a restriction on the total number of sheets that can be stacked in the output tray and yet there is still a limit on the height of the space into which the media sheets are fed when they exit the printer. However, when a low-rigidity medium such as natural tracing paper (NTP) is used as the print medium in a printer of this type the media sheet tends to buckle as the printer's output roller pushes the media sheet between the floating lid and the output tray, because the low-rigidity material fails to transmit compressive force efficiently.

Increasingly there is a drive to increase the versatility of printers and other media-handling devices. For example, there is an ongoing demand to increase the options offered by printers, including the range of materials that a single printer can handle. However, when the range of media-sheet materials that is to be handled by a single printer increases, this multiplies the number and types of stacking problems that can arise if the printer is intended to discharge the print output in the form of printed media sheets stacked on an output tray.

To date, media-sheet stacking problems at the output of printers and other devices have been handled in a piecemeal fashion, or not at all. Specifically, no media-sheet stacking system has been proposed which provides a comprehensive solution, to a range of stacking problems, sufficient to enable a robust and versatile printer to be constructed meeting the needs of modern customers.

Furthermore, the range and severity of stacking problems increase still further if the printer or other media-handing device is intended not only to stack a range of different materials but also to stack media sheets that have a predisposition to curl, for example because they were loaded into the device in a rolled up condition (e.g. as part of a continuous web wound onto a spool which was cut to form the media sheet). A further multiplication of stacking problems arises in a printer if it is desired to provide the printer with the capacity to output printed sheets with the printed side downwards (so that the pages of a print job can be printed in order) because in this case a predisposition to curl may produce a "reverse curl", that is, a curl in the opposite sense to usual.

Ongoing demand to increase printer capabilities has led to calls to build a page-wide large format inkjet printer. However, the capabilities desired for this type of printer include the ability to handle print media that are supplied as rolls (and thus may produce sheets that have a predisposition to curl, without an equivalent of the curl-reducing fusing process that takes place in LED printers), the ability to print onto a wide range of materials, and the ability to discharge print output by stacking media sheets on an output tray. To date, there has not been a satisfactory solution to the problems associated with stacking media sheets in this context.

The description below refers to certain example systems and methods implemented in the context of printers. However, it is to be understood that the described systems and methods can be applied in other contexts, for example in media-handling devices other than printers.

FIG. 1 illustrates an example of a media-sheet stacking system 10 for stacking media sheets on the output tray OT of a printer P. In FIG. 1 only a small portion of the printer is illustrated: that is, a portion where a nip including an output roller R pushes out media sheets from the printer towards the output tray OT.

The media-sheet stacking system 10 according to this example includes a kicker mechanism 20 including a kicker 25. The kicker mechanism 20 is arranged to move the kicker 25 in the vicinity of the output roller R to give a push to the trailing edge of a media sheet as it exits the printer and thereby to make the media sheet advance along the output tray OT.

The media-sheet stacking system 10 according to this example further includes a dynamic roof mechanism 30 including a movable belt 32 and a drive mechanism 33. In this example the movable belt 32 is formed as a continuous loop and is moved by a drive roller 33 positioned at one end of the loop (a belt tensioner 34 is provided at the other end of the loop).

The movable belt 32 is arranged so that one of its surfaces 32a faces the output tray OT and acts as a roof or lid to the output zone. The space between the belt surface 32a and the output tray OT acts as a channel which receives media sheets when they exit the printer. The height of this channel at a given time depends on the spacing between the top of the stack ST of media sheets present on the output tray OT at that time and the position of the facing surface 32a of the belt. The height of the channel may be controlled within limits to control the advance of the media sheets onto the output tray. A typical channel height for proper control of the media sheets is in the range of approximately 2 mm to approximately 4 mm.

At selected times (described below) the drive roller 33 is driven by a motor and controller (not shown) so that the surface 32a of the belt moves in the direction of advance of media sheets onto the output tray OT. The linear speed of the belt surface 32a may be set equal to or higher than the speed of the media sheet being stacked. In this case the media sheet is not pulled by the belt 32a; instead the belt simply reduces friction forces acting on the media sheet in the direction opposite to its advancing movement. In this way, rolling up of the media sheet is avoided and normal force exerted by the arms 40 pressing the belt 32 does not need to be increased up to a point such that marks would be left on the media sheet. In practice, when the speed of the belt is set equal to the speed of advance of the media sheet it has been found that manufacturing variability causes the belt speed sometimes to dip below the speed of the media sheet. When the belt speed is set slightly higher than the speed of advance of the media sheet, for example in the range of 5-10% higher than the speed of the media sheet, this compensates for manufacturing variability and may ensure that the speed of the belt does not fall below the speed of advance of the media sheet.

In this example the surface 32a of the belt functions as a floating lid or roof to the output zone because the belt surface 32a is biased towards the output tray OT by a biasing mechanism. An example of the biasing mechanism is illustrated in FIG. 3 (which omits certain other elements of the media-sheet stacking system, for clarity).

In this example the biasing mechanism takes the form of two spring-preloaded rocking arms 40 each having one end 40a mounted to rotate around a pivot point and a second end 40b arranged to press the belt 32 towards the output tray. The rocking arms 40 preload the belt 32 so that the surface 32a rests against the top of the stack ST of media sheets in the output tray, which reduces to substantially zero the height of the channel that receives media sheets exiting the printer. This allows media sheets to be stacked up to a relatively large thickness (within the limits of travel of the pre-load mechanism). However, it is not essential to bias the belt 32 by preloading the rocking arms. The stacking process is improved even when the positions of the rocking arms 40 are held constant (although, in that case, the fixed arm position that is consistent with an acceptable height for channelling the media sheets limits the maximum thickness of the stack).

The media-sheet stacking system 10 according to the example illustrated in FIG. 1 further includes guide ribs 45, a sensor 48 and a set of suspended weights 50 that shall be described below.

The kicker mechanism 20 and the dynamic roof mechanism 30 cooperate to implement a method of stacking media sheets on the output tray OT. The main stages of the method will now be described with reference to the sequence of images shown in FIGS. 2 A to 2 C.

Figure 2A:
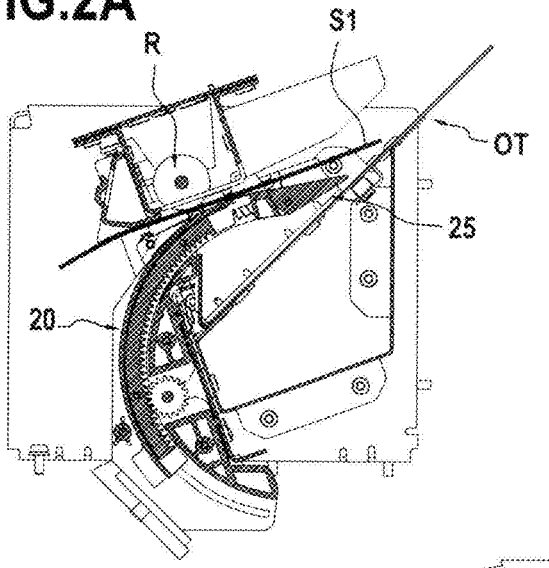
FIGS. 2 A to 2 C are a sequence of diagrams illustrating operation of a kicker in the media-sheet stacking system of FIG. 1.

When a media sheet S1 is being ejected from the printer the sheet S1 enters a media path where it is pushed along by the output roller R (as illustrated in FIG. 2A). At this time, in the media-sheet stacking system 20 of this example the kicker 25 is located at a forward position where it pinches the media sheets (if any) already stacked on the output tray.

Figure 2B:
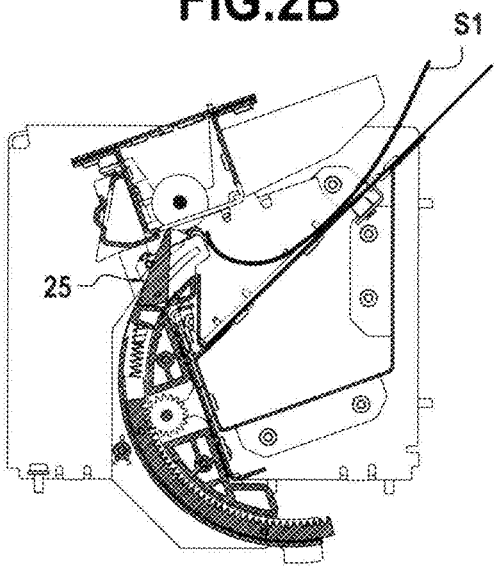
Figure 2C:
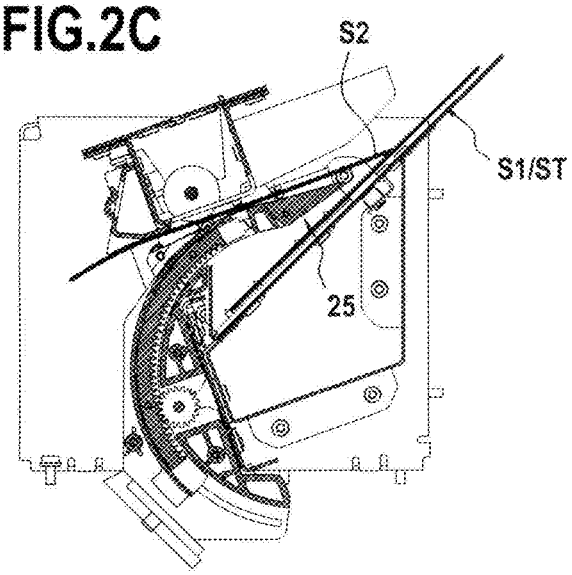

The output roller R continues to push the media sheet S1 onto the output tray until the trailing edge of the media sheet S passes the output roller R, when the media sheet no longer experiences a traction force to advance it further onto the output tray. At this time, as illustrated in FIG. 2B, the kicker mechanism 20 operates to retract the kicker 25, to release the pinch on the stacked media sheets (and to allow the rear portion of the latest sheet S1to drop towards the stack surface). As shown in FIG. 2C, the kicker mechanism 20then operates to extend the kicker 25 out again so that the tip of the kicker 25 kicks the media sheet S1 out of the printer onto the output tray OT, ensuring that the trailing edge is reliably ejected from the output roller. In this example the kicker mechanism 20 includes a rack and pinion to produce the desired movement of the kicker 25.

Once the current media sheet S1 has been ejected, in most cases its trailing edge may obstruct the media exit path from the printer (as illustrated in FIG. 2B). This is especially true for those media with curl. In this example the shape of the kicker 25 ensures that when the kicker tip kicks the trailing edge of the media sheet, the media sheet is moved away from the exit path leaving it unblocked for the next page being discharged from the printer.

As the media sheet advances to the output tray OT it can buckle between the output roller at the printer exit and the output tray. In this example of media-sheet stacking system there are guiding ribs 45 provided to cooperate with the shape of the kicker 25 to define a narrow path for guiding the path of the media sheet in this region between the output roller R and the output tray OT, thus reducing the ability of the media sheet to buckle.

While the media sheet is being advanced along the output tray, it may have a tendency to curl or roll up rather than keeping flat, especially in a case (such as that illustrated in the figures) where the output tray has an upward incline. However, in the media-sheet stacking system according to the present example, the belt 32 (or equivalent movable element, see below) narrows the path and, by moving faster than the media sheet, it prevents the media sheet from curling and from rolling up.

While a media sheet is being stacked on the output tray OT, previously stacked pages already on the output tray could be dragged out by the moving belt 32 or because of friction between media sheets. In this example the kicker 25 is controlled to pinch the media stack ST while the output roller is feeding the media sheet onto the output tray OT, and so the kicker 25 keeps the already-stacked sheets in place.

At the exit Z of the output tray, media sheets can roll up and cause an obstruction to media sheets that are stacked subsequently. In this example a set of suspended weights 50 is arranged in the vicinity of the output tray's exit end Z. The set of suspended weights may include one weight, two weights, or more than two weights. The weights 50 hang at a position such that they force the leading edge of media sheets to bend down, under their own weight, in the event that the media sheets are longer than the output tray and their ends E protrude beyond the exit end of the output tray. It has been found that weights of only a few grams can be sufficient to produce this bending of the media sheets.

In the absence of the set of weights 50 the leading edge of a media sheet stacked on the output tray may curl up in a case where the length of the media sheet is comparable to the length of the output tray. For this reason, when the weights 50 are not provided, undesired curling of the media sheets can be avoided by setting the length of the output tray so that it does not match the length of the media sheets. In practice, media sheets tend to come in standard lengths specified by standardization bodies (e.g. ISO, DIN, ANSI, ARCH, and so on). So the length of the output tray may be selected to avoid matching standard sheet lengths as defined by a set of these standards.

The shape of the exit end Z of the output tray has been found to play a part in determining whether or not media sheets curling up at the exit end of the output tray cause problems. If the exit end Z of the output tray has an equipotential surface (i.e. a relatively flat (horizontal or near horizontal) portion) then this may serve as a platform on which curling portions of the media sheet can accumulate and impede advance of subsequently-stacked sheets. So, when the exit end Z of the output tray has a shape that primarily is bent or curved convexly (i.e. to have a peak) this avoids providing a horizontal portion on which curling portions of the media sheets might accumulate. Instead, when the leading end of the media sheet passes the peak in the shape of the exit end Z it tends to tip over under its own weight, freeing the path of advance of a subsequent media sheet.

An example of a method of stacking media sheets on an output tray will now be described with reference to the flow diagram illustrated in FIG. 4. For the purposes of this explanation it shall be considered that several media sheets are already stacked on the output tray at the time when the stacking sequence illustrated by FIG. 4 begins. Also, it should be noted that although the description above presented a single kicker mechanism 20 moving a single kicker 25, in practice there may be a set of kickers 25 and associated movement mechanisms, and the set may include one kicker, two kickers or more than two kickers.

Figure 4:
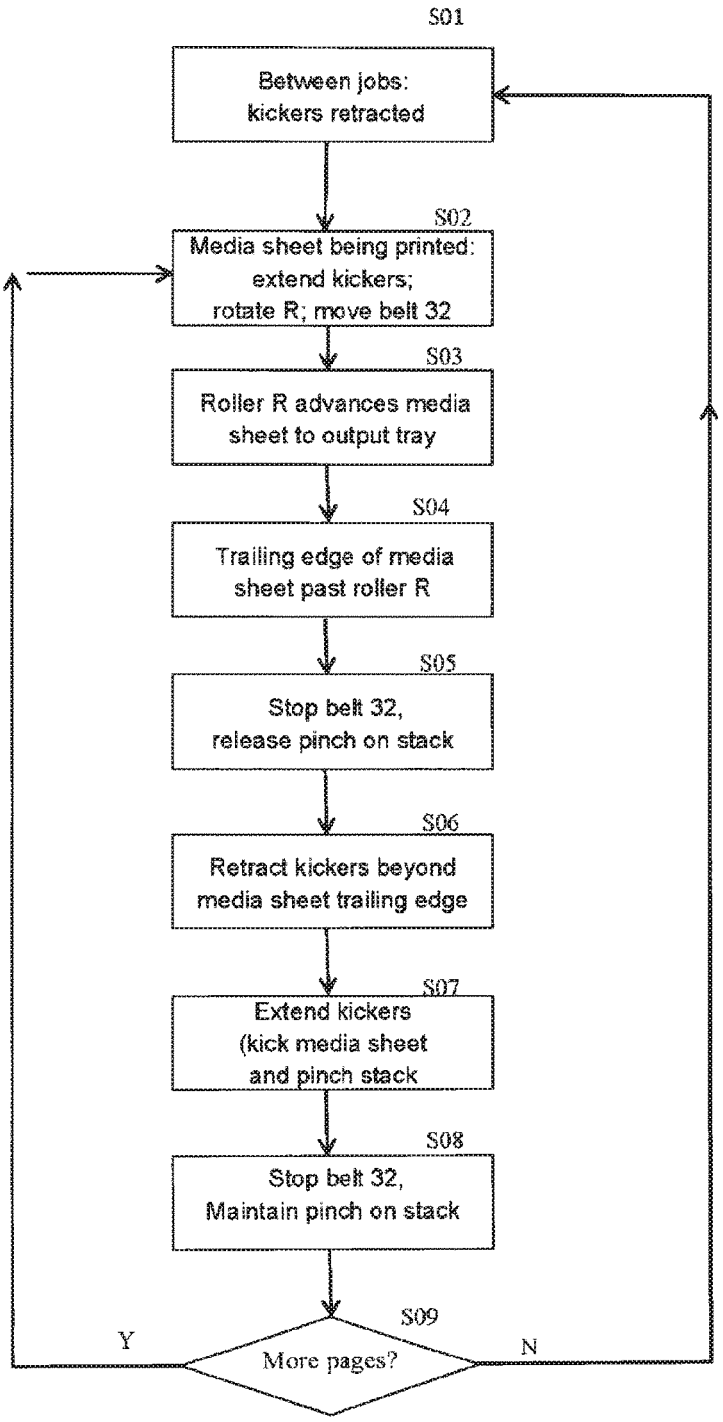
FIG. 4 is a flow diagram illustrating steps in an example method of stacking media sheets on a printer output tray.

S01 in FIG. 4: During intervals between print jobs the kickers 25 are retracted so that user can easily collect earlier printouts that are waiting on the output tray, without having to pull against the pinching force. At this time the belt 32 is stopped but it is self-adjusted to be in contact with the top sheet in the media stack with a controlled preload.

S02 in FIG. 4: When a media sheet is printed and is then detected on the output media path the kickers 25 are extended to pinch the media stack, and the output roller R and belt 32 both start moving.

S03 in FIG. 4: The output roller pushes the printed media sheet to the output tray OT.

S04 in FIG. 4: Then, when a sheet-presence sensor 48 arranged close to the output roller R ceases to detect a media sheet this means that the trailing edge of the media sheet is reaching the output roller R. After a calibrated time has elapsed, an output controller (not shown) assumes that the media sheet has past the output roller R.

S05 in FIG. 4: Then, the belt 32 is stopped and the kickers 25 are allowed to release the stack of media.

S06 in FIG. 4: At this time, the kickers are retracted past the trailing edge of the media sheet.

S07 in FIG. 4: When the kickers 25 are extended out again the tip of the kicker pushes the media sheet out while keeping it below the kicker shape. The kicker is extended until the point where it pinches the entire stack of sheets on the output tray.

S08 in FIG. 4: At this point, a new sheet has been stacked onto the output tray, the belt 32 is stopped and the stack of sheets is held in a pinch. So, the system is ready to receive a new sheet.

S09 in FIG. 4: Finally, when no more media sheets are expected to require stacking on the output tray (e.g. because all pages of the current print job have been printed and stacked), the kickers 25 are retraced to return to the standby position described under S01.

To reduce costs, in an alternative example of the method the media presence sensor is not provided and the method operates using an estimate of the positions of the leading and trailing edges of the media sheets wherein the estimates are based on times such as those when edges have been detected in other print engine areas.

In certain examples of media-sheet stacking system a one-direction valve element may be provided on the output tray to prevent users from being able to push media sheets back into the output tray, from the wrong direction, after they have been removed from the output tray. FIGS. 5A and 5B illustrate an example of a one-way valve element 35. In the example of FIGS. 5A and 5B, the one way valve element In certain examples of media-sheet stacking system the dynamic roof mechanism can be constructed as a foldable assembly, that is, an assembly that pivots relative to the printer body, away from the output tray, so as to make it easier for a user to remove sheets stacked on the output tray (especially in a case where the media sheets are shorter than the output tray). In a similar way, in certain examples of media-sheet stacking system the output tray can be constructed as a foldable element, that can be moved away from the dynamic roof assembly, to facilitate the user's access to the stacked media sheets.

Examples of media-sheet stacking systems which combine a dynamic roof mechanism (having a movable element that faces the output tray across a space and can move in the direction of advance of the media sheets onto the output tray) with a kicker (to kick the trailing edge of the media sheets in the direction of advance) reduce curling and buckling of media sheets as they advance along the output tray during the stacking process. Thus, these examples of stacking systems have the following qualities:

the ability to stack a wide range of media types, ranging from thin NTP to thick photographic paper, and the ability to stack media coming from a roll without the need to uncurl the roll using a process (such as fusing) performed in the printer.

These qualities are features which, when the stacking system is used in a page wide large format inkjet printer, enable the printer to support the robust stacking of several types of media (including curled media which may not be uncurled by the printing process because inkjet printing is used, rather than LED-based imaging). Indeed the reduction in curling-related stacking problems can be sufficient to enable media sheets having their printed side downwards to be stacked up on the output tray. This makes it possible to print the pages of a print job in order, starting with the first, yet to have the pages in the correct order within the stack. An additional advantage of being able to print the pages of a print job in order is that it is no longer necessary for the image processor to complete processing of the entire print job before launching the start of the printing. This can reduce the time between commanding a print and execution of the print.

Examples of the dynamic roof mechanism used in the example stacking systems discussed above produce better registration (alignment) between the ends of long media sheets in the stack. When the registration between the ends of the media sheets is good then it is easier to achieve a reliable pinch of the stacked media sheets.

Examples of the dynamic roof mechanism used in the example stacking systems discussed above increase the traction force on media sheets exiting the printer and in that way reduce slippage of the media sheet relative to the output roller (which helps reduce star-wheel marks, thereby improving print quality.

Various modifications and extensions can be made of the examples described above. For instance, although the example media-sheet stacking system illustrated in FIG. 1 makes use of a dynamic roof mechanism in which a belt element faces the output tray and is moved in the direction of advance of media sheets onto the output tray, other dynamic roof structures may be used in which motion, in the direction of advance of the media sheet along the output tray, is generated by a driven element (or set of elements) that oppose the output tray, to compensate for frictional forces that otherwise oppose the advance of the media sheet. An example of another dynamic roof structure is a driven roller, or a set of rollers including one, two, or more than two driven rollers.

The invention claimed is:

1. A media-sheet stacking system for stacking media sheets on an output tray for a device, the stacking system comprising:

a kicker to advance a media sheet along the output tray by pushing a trailing edge of the media sheet exiting the device, wherein the kicker is moveable between an extended position and a retracted position, the kicker to retract from the extended position to the retracted position responsive to the trailing edge of the media sheet exiting the device, and after the kicker has retracted from the extended position to the retracted position, the kicker is to extend from the retracted position to the extended position to push the media sheet onto the output tray;

an output roller to push the media sheet to the output tray;

a sensor to sense presence of the media sheet, wherein the kicker is to retract from the extended position to the retracted position responsive to the sensor ceasing to detect the presence of the media sheet;

a movable element arranged to face the output tray across a space receiving media sheets exiting the device; and a drive mechanism to drive the movable element in a direction of advance of the media sheet along the output tray.

2. The media-sheet stacking system of claim 1, wherein the movable element comprises a belt facing the output tray.

3. The media-sheet stacking system of claim 2, wherein the drive mechanism is configured to move the belt in the direction of advance of the media sheet at a speed faster than a speed of advance of the media sheet along the output tray.

4. The media-sheet stacking system of claim 3, further comprising a biasing mechanism to bias the belt towards a stack of media sheets on the output tray.

5. The media-sheet stacking system of claim 4, wherein the biasing mechanism comprises a set of arms each having one end mounted to rotate about a pivot point and another end to push the belt towards the stack of media sheets on the output tray.

6. The media-sheet stacking system of claim 1, wherein the kicker has a curved profile, and the curved profile of the kicker is to move along a curved path as the kicker is moved between the extended position and the retracted position.

7. The media-sheet stacking system of claim 6, wherein the kicker has a tip shaped to push the trailing edge of the media sheet exiting the device into a position away from an exit path from the device.

8. The media-sheet stacking system of claim 7, further comprising guide ribs positioned at an exit of the device to cooperate with the kicker to define a channel to guide media sheets exiting the device.

9. The media-sheet stacking system of claim 1, wherein the output tray has an exit end remote from the device, and a shape of the exit end is curved or bent to avoid formation of a platform for accumulation of curling media sheets.

10. The media-sheet stacking system of claim 9, further comprising a set of suspended weights hanging proximate the exit end of the output tray to bend over ends of media sheets stacked on the output tray when the ends of media sheets extend beyond the exit end of the output tray.

11. The media-sheet stacking system of claim 9, wherein the length of the output tray is set to avoid matching any of a set of standard lengths specified for media sheets.

12. The media-sheet stacking system of claim 1, wherein when the kicker is in the retracted position the media sheet is allowed to drop towards a surface of a stack of media sheets on the output tray.

13. The media-sheet stacking system of claim 12, wherein when the kicker is in the extended position the kicker pinches a top surface of the stack of sheets.

* * * * *